US012752168B2

(12) United States Patent
Cook et al.

(10) Patent No.: US 12,752,168 B2
(45) Date of Patent: Oct. 6, 2026

(54) RUNNING HARNESS

(71) Applicant: Nike, Inc., Beaverton, OR (US)

(72) Inventors: Christopher S. Cook, Portland, OR (US); John T. Dimoff, Portland, OR (US)

(73) Assignee: NIKE, INC., Beaverton, OR (US)

( * ) Notice: Subject to any disclaimer, the term of this patent is extended or adjusted under 35 U.S.C. 154(b) by 278 days.

(21) Appl. No.: 18/628,369

(22) Filed: Apr. 5, 2024

(65) Prior Publication Data

US 2024/0390757 A1 Nov. 28, 2024

Related U.S. Application Data

(60) Provisional application No. 63/503,583, filed on May 22, 2023.

(51) Int. Cl.
*A63B 69/00* (2006.01)

(52) U.S. Cl.
CPC ..... *A63B 69/0028* (2013.01); *A63B 69/0059* (2013.01)

(58) Field of Classification Search
CPC . A63B 69/0028; A63B 69/0059; A63B 69/00; A63B 21/00; A63B 22/00
See application file for complete search history.

(56) References Cited

U.S. PATENT DOCUMENTS 4,337,938 A 7/1982 Rodriguez
5,141,488 A * 8/1992 Schrader ..... A61F 5/3738 128/878
5,688,137 A * 11/1997 Bustance ..... A63B 69/0059 2/102
6,099,446 A 8/2000 Johnson et al.
6,126,554 A 10/2000 Poscente
6,691,318 B1 2/2004 Davis
7,147,590 B2 12/2006 Toven
8,323,127 B2 12/2012 Webb et al.
9,295,869 B2 3/2016 Washington
9,855,454 B2 1/2018 Ismail et al.
10,127,828 B2 11/2018 Arnold
10,328,324 B1 6/2019 Case
10,702,731 B2 7/2020 Rankin
(Continued)

FOREIGN PATENT DOCUMENTS

CN 113318408 A 8/2021
CN 113274714 B 8/2022
(Continued)

*Primary Examiner* — Timothy A Musselman
(74) *Attorney, Agent, or Firm* — Bookoff McAndrews, PLLC

(57) ABSTRACT

A running harness, having a body; a first strap coupled to a first side of the body, wherein the first strap includes at least one device fastener; and a first training device. The first training device including a base extending from a first side to a second side; a strap fastener provided at the first side of the base and configured to couple to and be removed from the at least one device fastener of the first strap, wherein a position of the strap fastener along a length of the first strap is adjustable; and a band coupled to the second side of the base and having a predetermined elasticity, wherein the band includes a loop configured to be expanded in a direction away from the second side and the strap fastener.

20 Claims, 8 Drawing Sheets

(56) References Cited

U.S. PATENT DOCUMENTS

| | | | | |
|---|---|---|---|---|
| 11,191,991 | B2 | 12/2021 | Parent et al. | |
| 2003/0040408 | A1 | 2/2003 | Cooper, Sr. | |
| 2004/0250332 | A1* | 12/2004 | Tadin | A41D 27/20 2/94 |
| 2008/0153615 | A1 | 6/2008 | Baird et al. | |
| 2010/0311022 | A1 | 12/2010 | Asper et al. | |
| 2011/0111930 | A1 | 5/2011 | Byrd et al. | |
| 2015/0208736 | A1 | 7/2015 | Bergman et al. | |
| 2016/0228755 | A1 | 8/2016 | Doyle | |
| 2018/0200557 | A1 | 7/2018 | Prospero et al. | |

FOREIGN PATENT DOCUMENTS

| | | | |
|---|---|---|---|
| FR | 2930171 | B1 | 10/2009 |
| FR | 3111522 | B1 | 7/2022 |
| JP | 2020182610 | A | 11/2020 |
| WO | 2011111927 | A2 | 9/2011 |
| WO | 2016135761 | A1 | 9/2016 |

* cited by examiner

RUNNING HARNESS

CROSS-REFERENCE TO RELATED APPLICATION

This application claims priority under 35 U.S.C. § 119 (e) to Provisional U.S. Patent Application No. 63/503,583, filed May 22, 2023, the disclosure of which is hereby incorporated by reference in its entirety.

FIELD

The present embodiments relate generally to a running harness, and in particular to a running harness configured to maintain proper arm alignment of a runner.

BACKGROUND

This section provides background information related to the present disclosure which is not necessarily prior art.

A running vest may be worn by or secured to a runner while the runner is running. Some running vests include straps with handles to facilitate free swinging of a runner's arm. A runner grips the straps with a hand and swing the hands past the waist while holding the straps during running.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

Corresponding reference numerals indicate corresponding parts throughout the several views of the drawings.

DETAILED DESCRIPTION

Figure 1A:
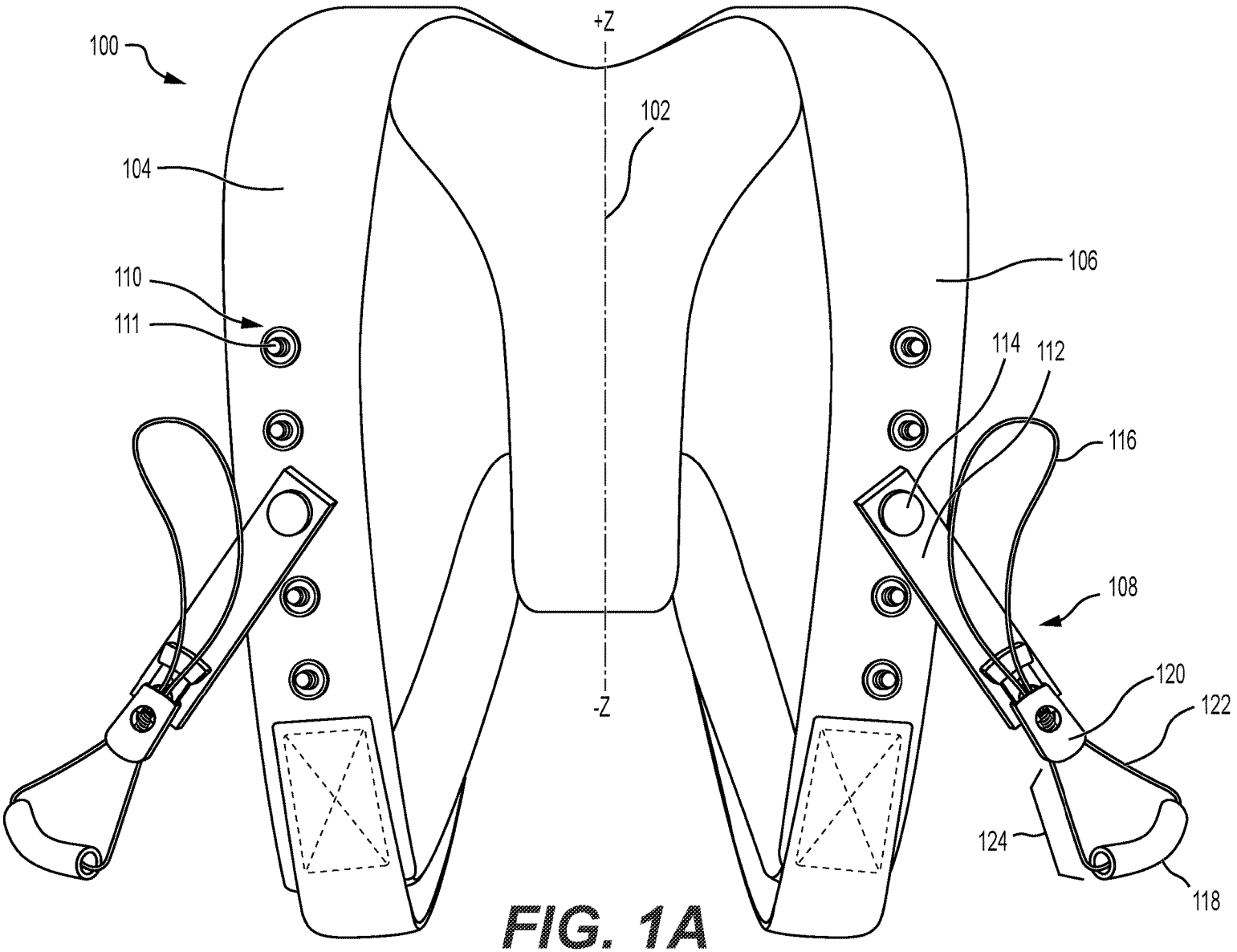
FIG. 1A illustrates an exemplary running harness including one or more training devices, according to an exemplary embodiment.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

In the discussion that follows, terms "about," "approximately," "substantially," and the like, when used in describing a numerical value, denote a variation of +/−10% of that value, unless specified otherwise.

Figure 1B:
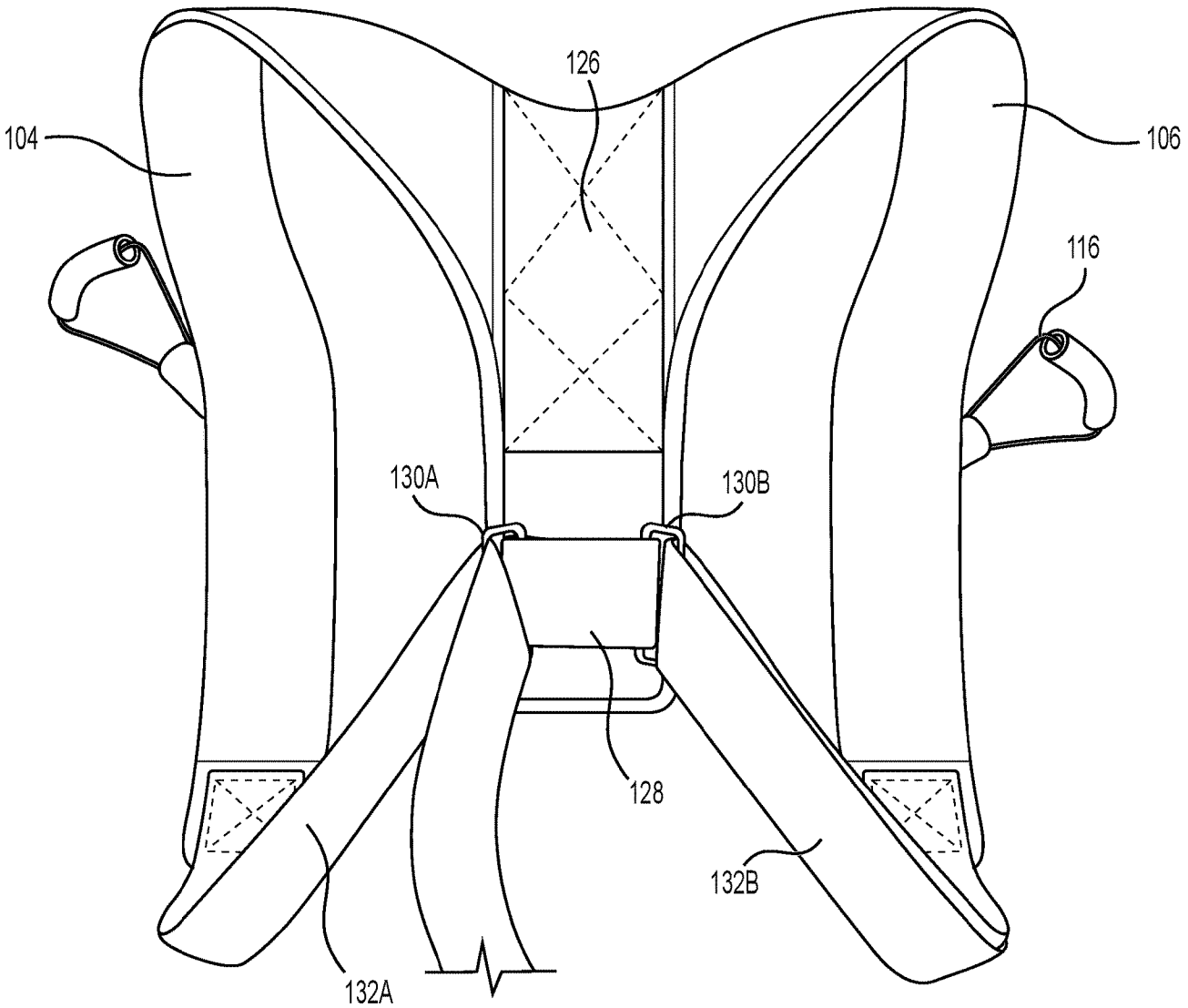
FIG. 1B illustrates a rear view of the exemplary running harness including one or more training devices of FIG. 1A.
Figure 1C:
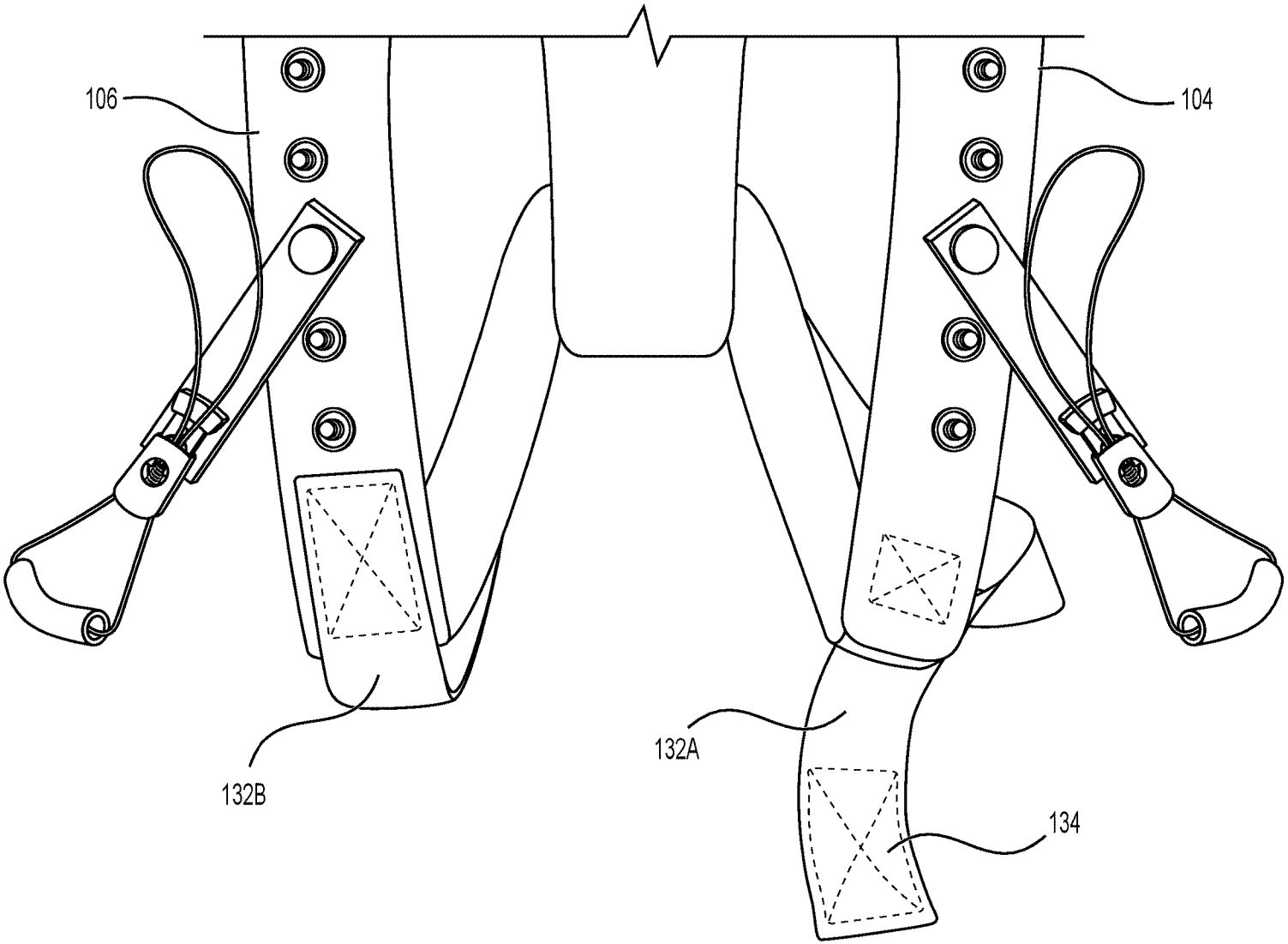
FIG. 1C illustrates a front view of the exemplary running harness including one or more training devices of FIG. 1A.
Figure 2:
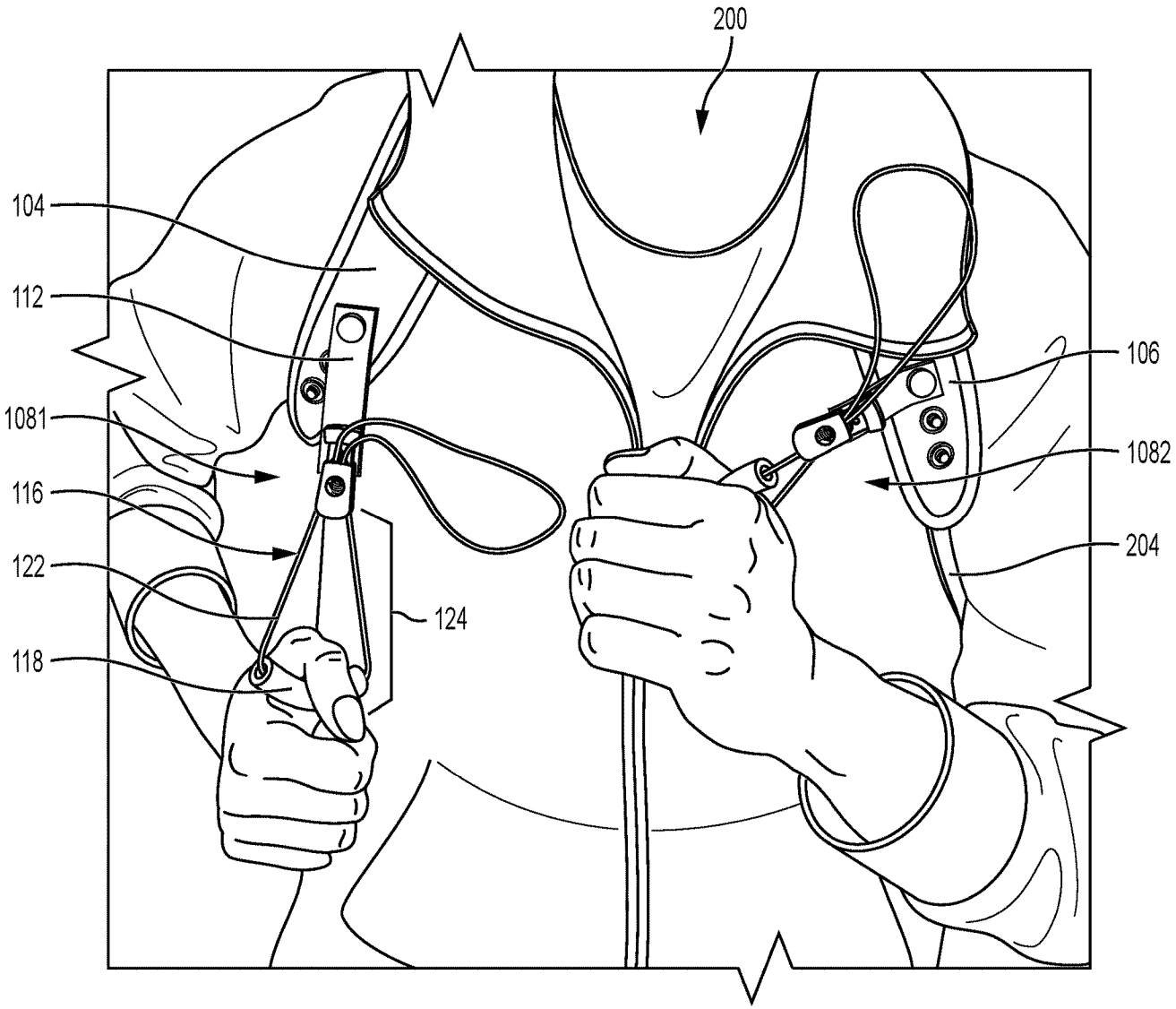
FIG. 2 illustrates an exemplary running harness including the one or more training devices of FIG. 1A being used, according to an exemplary embodiment.

FIG. 1A illustrates an exemplary running harness 100 including at least one training device 108, according to an exemplary embodiment, and FIG. 2 illustrates a user 200 wearing an exemplary running harness including the at least one training device 108, according to an exemplary embodiment. Referring to FIGS. 1A-2, the running harness 100 may include a body 102, a first strap 104 (e.g., right strap from the perspective the user 200 wearing the running harness 100) coupled to a first side of the body 102, a second strap 106 (e.g., left strap from the perspective of a user waring the running harness 100) coupled to a second side of the body 102, and one or more training devices 108 configured to receive a thumb of the user 200 to restrain arm movement during running.

The body 102 may be symmetrical across a Z-axis and be configured to extend along a back of the user 200. The body 102 may increase in width in a positive Z direction (or upward) to be wider at the user's shoulders, however, aspects disclosed herein are not limited to a particular shape of the body 102, as will be described later with respect to FIGS. 6A through 6C.

The first strap 104 may be configured to be worn over a right shoulder of the user 200 and extend down a right side of an upper body or torso of the user 200, and the second strap 106 may be configured to be worn over a left shoulder of the user 200 and extend down a left side of the upper body of the user 200. A configuration of the first strap 104 may mirror a configuration of the second strap 104, and for convenience of description, the configuration of the first strap 104 will be described. However, one of ordinary skill in the art will understand that the description of the first strap 104 may be applied to the second strap 106.

Referring to FIG. 1B, the first strap 104 may be coupled to a top of the body 102 at an upper end and a bottom of the body 102 at a lower end. The body 102 further includes a back portion 126. The back portion 126 may include a material that is more durable than a material of the remainder of the body 102. The body 102 further includes a connective portion 128. The connective portion 128 includes a first loop connected to a first ring 130*a* and a second loop connected to a second ring 130*b*. The first ring 130*a* and the second ring 130*b* may both be D-rings or may have an otherwise D-shape. It is contemplated that the first ring 130*a* and the second ring 130*b* may be a G-ring, an S-ring, or any other suitable means for connecting portions of the running harness 100.

The first strap 104 further includes a substrap 132*a*. The second strap 106 further includes a substrap 132*b*. The substrap 132*a* is configured to couple to the body 102 via the first ring 130*a*. A portion of the substrap 132*a* is routed through the first ring 130*a*. The substrap 132*b* is configured to couple to the body 102 via the second ring 130*b*. A portion of the substrap 132*b* is routed through the second ring 130*b*.

Referring to FIG. 1C, each of the substraps 132*a*, 132*b* include a fastener 134, although only fastener 134 is shown on substrap 132*a* for illustrative purposes. Fastener 134 is a hook and loop fastener. Fastener 134 is configured to couple to the first strap 104 of the running harness 100. Thus, the first strap 104 may comprise a material suitable for coupling the substraps 132*a*, 132*b* thereto. It is contemplated that fastener 134 may be any fastener suitable for connecting substraps 132*a*, 132*b* to the respective straps 104, 106 of the running harness 100.

The first strap 104 may include a plurality of device fasteners 110. Each device fastener 110 may be configured to couple to one training device 108. The plurality of device fasteners 110 may be arranged along a length of the strap 104 in the Z-direction so that a position of the training device 108 may be adjustable. The plurality of device fasteners 110 may be positioned to correspond to an upper portion of the shoulder of the user 200 to facilitate a predetermined and/or desired arm alignment during running.

As exemplified in FIGS. 1A-1C, each device fastener 110 may include a protrusion 111 (e.g., button stud), but aspects disclosed herein are not limited. For example, alternatively or in addition to the protrusion 111, each device fastener 110 may alternatively include a recess or hole (e.g., a button socket). As an alternative to the plurality of device fasteners 110, a single device fastener 110 may be implemented to have an adjustable position along the Z-direction, such as a slider, zipper, etc. and a lock configured to maintain a selected position. Aspects disclosed herein are not limited to a coupling mechanism of the one or more training devices 108 to the first strap 104. Such alternatives may provide a continuous adjustment of a position of the training device 108 along the Z-direction, but may still be configured to lock to maintain a selected position.

The one or more training devices 108 may be removably coupled to the first strap 104 and/or the second strap 106. The one or more training devices 108 may include a base or tab 112, a strap fastener 114, a band or cable 116, a thumb grip 118, and a lock 120.

The base 112 may be made of a flexible material (e.g., nylon) to facilitate flexible movement, but aspects disclosed herein are not limited to a material of the base 112. For example, the base 112 may alternatively be made of a rigid material (e.g., a hard plastic). The strap fastener 114 may be provided at a first side or end of the base 112, and the lock 120 may be provided at a second side or end of the base 112 that is opposite to the first side.

The strap fastener 114 may be configured to couple to one of the plurality of device fasteners 110. The strap fastener 114 may include, for example, a recess (such as a recess in a button socket configuration, as exemplified in FIG. 4B) configured to couple (e.g., snap or pressed-fit) to the protrusion 111 of the device fastener 110. Alternatively to the recess, the strap fastener 114 may include a protrusion configured to couple to a recess of the device fastener 110. An exemplary fastening arrangement between the first strap 104 and the training device 108 is described in more detail with respect to FIG. 4B, but is not limited. For example, as an alternative to the plurality of devices fasteners 110 and the strap fastener 114, the first strap 104 may include a hook-and-loop fastener or material configured to couple to a corresponding hook-and-loop fastener or material of the training device 108. A fastening arrangement between the training device 108 and the first strap 104 and/or the second strap 106 may be configured to maintain a position of the training device 108 when pulled by the user 200. In some examples, the running harness 100 may be customized to a user, and the training device 108 may be fixed (e.g., sewn, adhered, glued, fused, etc.) to the running harness 100 at a predetermined position based on a height and/or arm length of the user 200. In some examples, the running harness 100 may include multiple training devices 108 on each strap 104, 106 fixed at various heights along each strap 104, 106.

The band 116 may include an elastic material and have a predetermined elasticity. The band 116 may be coupled to the base 112 via the lock 120. The band 116 and the lock 120 may be configured such that at least one portion includes a loop 122 configured to receive the thumb of the user 200. A size of the loop 122 may be configured to receive the thumb of the user 200, but may prevent insertion of an entire hand or first of the user 200. The loop may have a length 124, which is described in more detail hereinafter. The loop 122 of the band 116 may extend beyond the second side of the base 112 and be configured to be stretched and/or expanded in a direction outward and/or away from the user 200, the base 112, the lock 120 and/or the strap fastener 114.

The thumb grip 118 may be provided on the loop 122 of the band 116. The thumb grip 118 may include a cylindrical tube having a soft or cushion material, but aspects disclosed herein are not limited. The thumb grip 118 may add width or thickness to the band 116 and be configured to provide friction against the thumb of the user 200. As an example, the thumb grip 118 may include a polymer material, a rubber material, or a textured material. The thumb grip 118 may be loose so as to move freely along the band 116. Alternatively, the thumb grip 118 may be fixed (e.g., adhered) to the band 116 to restrain sliding of the user's thumb along the band 116. For example, the thumb grip 118 may include a cushion material adhered (e.g., glued) to an inner side of the loop 122 and not necessarily include a tube that encloses the band 116.

The lock 120 may be coupled (e.g., sewn to, adhered, etc.) to the end of the base 112 opposite the end of the base 112 that is fastened to the first strap 104 or the second strap 106. The band 116 may extend through the lock 120, and the lock 120 may be configured to be unlocked or opened to allow movement of the band 116 through the lock 120 to adjust a length or size of the loop 122. The lock 120 may be configured to be closed or locked to restrain movement of the band 116 and maintain the length or size of the loop 122. When the lock 120 is in an unlocked configuration, the band 116 may be moved through the lock 116 to adjust the size of the loop 122 and/or to control a distance 124 between the lock 120 and the thumb grip 118. The size of the loop 122 may be adjusted to accommodate a size of the thumb of the user 200 and/or a based on a desired arm alignment during running. A portion of the band 116 that is provided on an opposite side of the lock 120 as the loop 122 may also be a loop to prevent separating the band 115 from the lock 120, or alternatively may be two separate ends. The lock 120 will be described in more detail with reference to FIG. 4A.

The distance 124 between the lock 120 and the thumb grip 118 may reflect an effective stretchable length of the loop 122, as the remaining portion of the loop 116 above the lock 120 may remain slack during use, and the lock 12 may act as a pivot point or connector. As previously described, the distance 124 may be configured to allow insertion of the thumb, but may prevent insertion of an entire hand or first of the user 200. As will be described in more detail with reference to FIG. 4A, the distance 124 may be adjusted to maintain one or more predetermined positions or position ranges of the user's thumb or hand during running, such as a predetermined distance range away from the user's chest or torso. The distance 124 may be configured to be in a range of 2 inches to 8 inches, depending on how the band 116 is stretched and a position of an arm of the user 200 during an arm swing, but aspects disclosed herein are not limited. The distance 124 may further be configured to be in a range of 3 inches to 6 inches. The distance 124 may further be configured to be in a range of 4 inches to 5 inches. In examples, distance 124 allows for a user's arm to maintain a 45 degree angle. The distance 124 may be predetermined based on an anatomy (e.g., arm length or height) of the user 200. For example, a shorter user 200 may use the lock 120 to adjust the distance 124 to be, for example, in a range of 3 inches when the loop 122 is in a relaxed state and 10 inches when the loop 122 is in an expanded state and an arm of the user 200 is at a bottom of an arm swing. A taller user 200 may use the lock 120 to adjust the distance 124 to be, for example, in a range of 6 inches when the loop 122 is in a relaxed state and 14 inches when the loop 122 is in an expanded state and an arm of the user 200 is at the bottom of the arm swing. The elasticity of the band 116 may be configured to maintain a predetermined range of the distance 124.

As shown in FIG. 2, the user 200 may grip the one or more training devices 108 during running to restrain an arm swing and maintain a desired arm alignment. The one or more training devices 108 may include a first training device 1081 coupled to the first strap 104 and a second training device 1082 coupled to the second strap 106. The user 200 may hang a right thumb on the first training device 1081 and a left thumb on the second training device 1082. The positions where the first training device 1081 and the second training device 1082 are coupled to the first strap 104 and the second strap 106, respectively, along with a size of the loop 122, the distance 124, and/or the elasticity of the band 116, may be configured to maintain at least one predetermined arm swing parameter. The predetermined arm swing parameter may include a predetermined angle range at an elbow between an upper arm and a forearm of the user 200 during use, a predetermined position range of the arm of the user 200 (e.g., relative to the torso of the user 200, in a horizontal direction, etc.), and/or a predetermined position or position range of a hand of the user 200 (e.g., predetermined rearward-most position and/or a forward-most position during use). In some examples, the predetermined arm swing parameter may also include a predetermined distance range of the distance 124 based on an anatomy (e.g., arm length or torso length) of the user 200.

The positions where the first training device 1081 and the second training device 1082 are coupled to the first strap 104 and the second strap 106, respectively, along with a size of the loop 122, may also be based on dimensions of the user 200 (e.g., a length of the arm of the user 200, a height of the user 200, or a length of upper arm of the user 200 and/or the forearm of the user 200). The body 112 of the training device 108 may have a predetermined length in consideration of maintaining the predetermined arm swing parameter. In some examples, a plurality of training devices 108 may be provided, each having a different length of the body 112, and the user 200 may select a training device 108 among the plurality of training devices 108 based on the length of the body 112.

During running, the user 200 may swing right and left arms. FIG. 2 shows a position of the user 200 where the right arm of the user 200 is at a rearward-most position during an arm swing and the left arm of the user 200 is at a forward-most position during the arm swing. As shown in FIG. 2, a right hand of the user 200 may be at or above a waist or hip of the user 200 at the rearward-most position, and a left hand of the user 200 may be at or below an armpit of the user 200 at the forward-most position. The right thumb of the user 200 may pull on the band 116 to stretch the loop 122 of the first training device 1081 such that the distance 124 between the lock 120 and the thumb grip 118 has increased as compared to a situation where the band 116 is not being pulled. Similarly, the left thumb of the user 200 may pull on the band 116 to stretch the loop 122 of the second training device 1082. The left hand of the user 200 may be a predetermined distance away from the chest. The elasticity of the band 116 may be predetermined and configured to result in a maximum predetermined distance 124 between the lock 120 and the thumb grip 118 when the band 116 is pulled by the thumb of the user 200 and/or based on the predetermined arm swing parameter (e.g., such that the hand of the user 200 is at a predetermined position at the rearward-most position and/or the forward-most position).

Figure 3C:
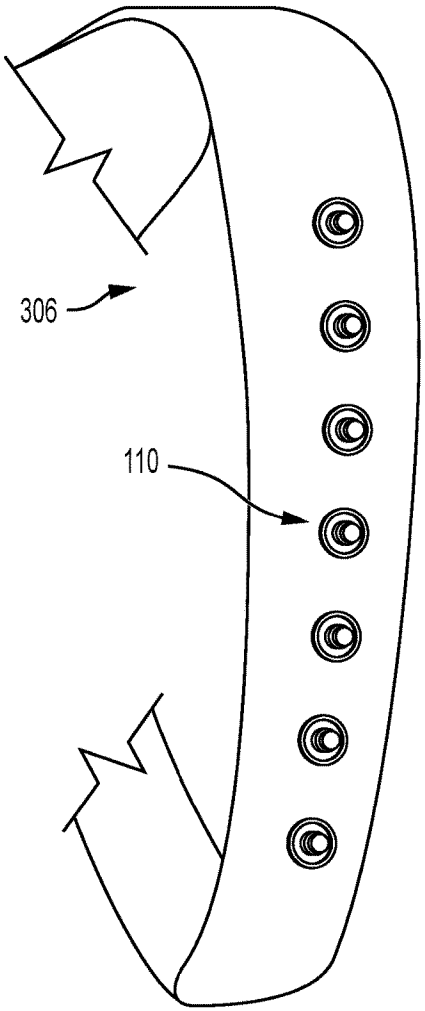
FIG. 3C illustrates an exemplary strap configured to couple to the one or more training devices of FIG. 1A, according to an exemplary embodiment.
Figure 3B:
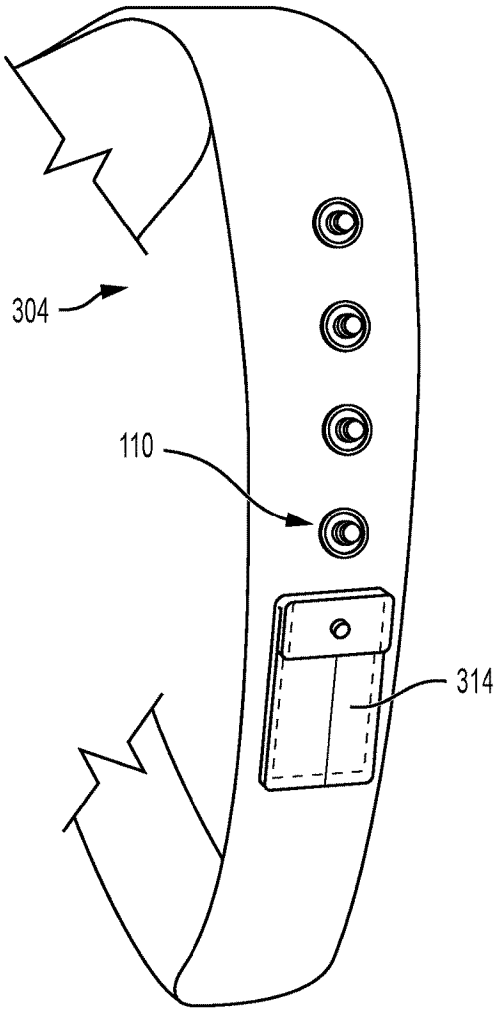
FIG. 3B illustrates an exemplary strap having a pocket and configured to couple to the one or more training devices of FIG. 1A, according to an exemplary embodiment.
Figure 3A:
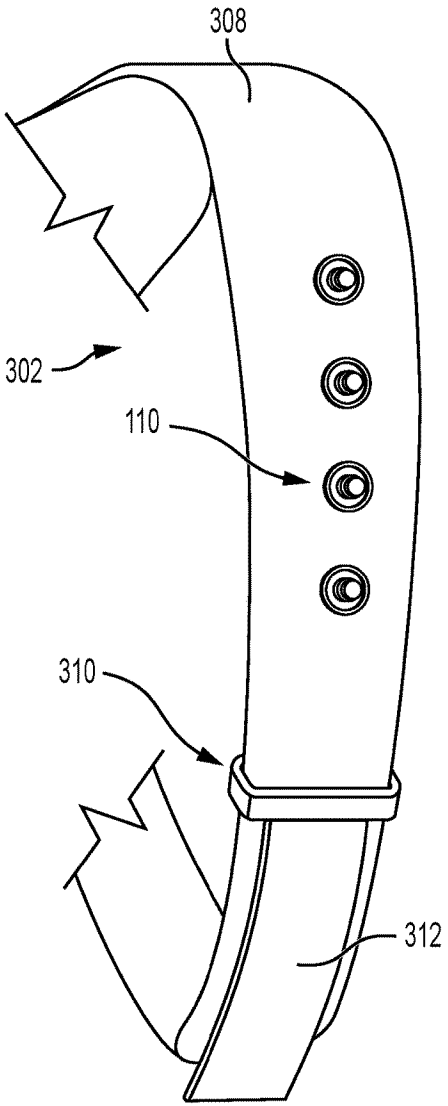
FIG. 3A illustrates an exemplary strap having an adjustment system and configured to couple to the one or more training devices of FIG. 1A, according to an exemplary embodiment.

FIGS. 3A-3C show various implementations of a strap that could be used for the running harness. For example, referring to FIG. 3A, a strap 302 may include a strap adjustment system 310 below the plurality of device fasteners 110 to adjust a length of the strap 302 in the Z direction. The strap 302 may include an upper body 308 (e.g., foam or polymer strap) coupled to an upper side of a back support or body (e.g., body 102) of a harness and a lower body 312 (e.g., fabric band) coupled to a lower side of the back support or body. The strap adjustment system 310 may couple the upper body 308 to the lower body 312 and may allow adjustment of one of the upper body 308 and the lower body 312 relative to the other of the upper body 308 and the lower body 312. For example, the strap adjustment system 310 may include a buckle or clip through which the lower body 312 is threaded and/or pulled to adjust a length between the lower body 312 and the body of the harness, similar to an adjustment of a backpack strap, to tighten the strap 302 to a user. In some examples, the strap adjustment system 310 may include a buckle or clip through which the upper body 310 is threaded to further adjust a position of the plurality of device fasteners 110. Aspects disclosed herein are not limited to implementations of the strap adjustment system 310.

In addition, aspects disclosed herein are not limited to implementations of a strap that couples to the at least one training device 108. Referring to FIG. 3B, a strap 304 may include a pocket 314 provided above or below (e.g., below) the plurality of device fasteners 110. In some examples, the pocket 314 may include one or more of the plurality of device fasteners 110. In some examples, the pocket 314 may be configured to carry weight and/or fitness equipment, and/or the running harness 100 may be implemented as a weighted vest. Referring to FIG. 3C, a strap 306 may include the plurality of device fasteners 110, which may extend down substantially an entire length of the strap 306 to provide more possible positions of the one or more training devices 108 (FIGS. 1-2).

Figure 4B:
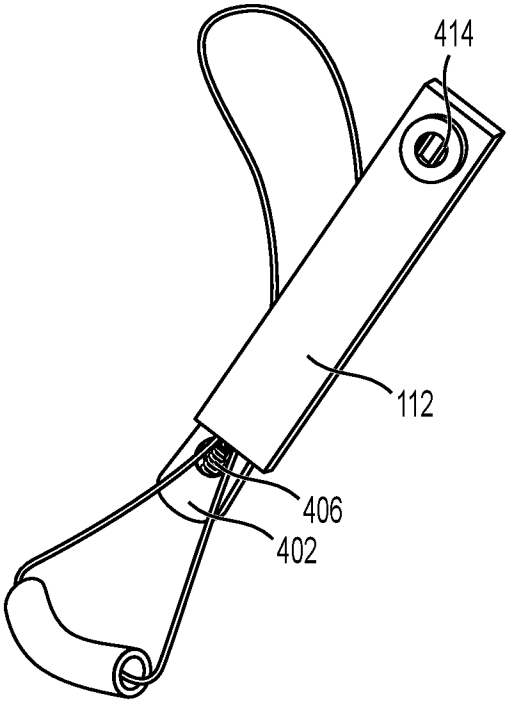
FIG. 4B illustrates a rear view of the one or more training devices of FIG. 1A, according to an exemplary embodiment.
Figure 4A:
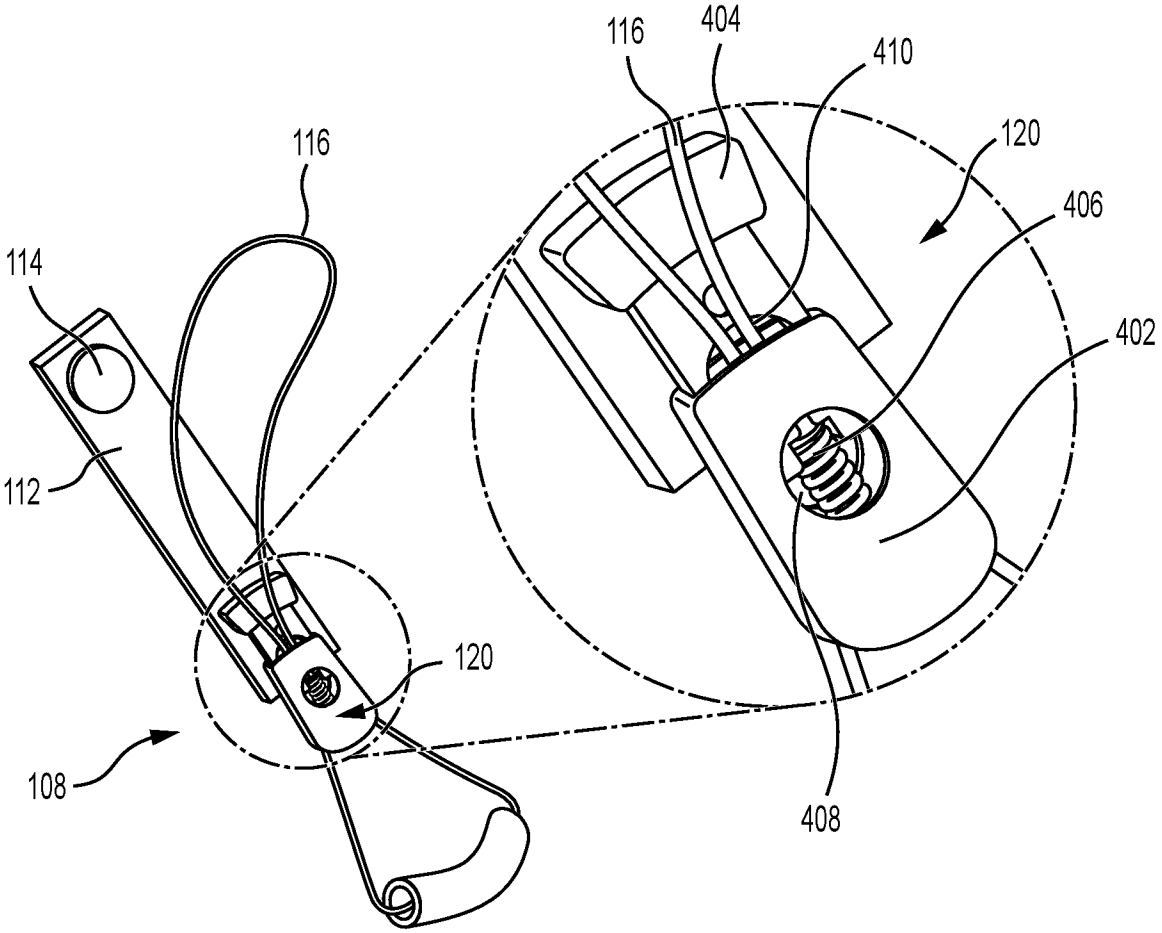
FIG. 4A illustrates a front view of the one or more training devices of FIG. 1A, according to an exemplary embodiment.
Figure 5:
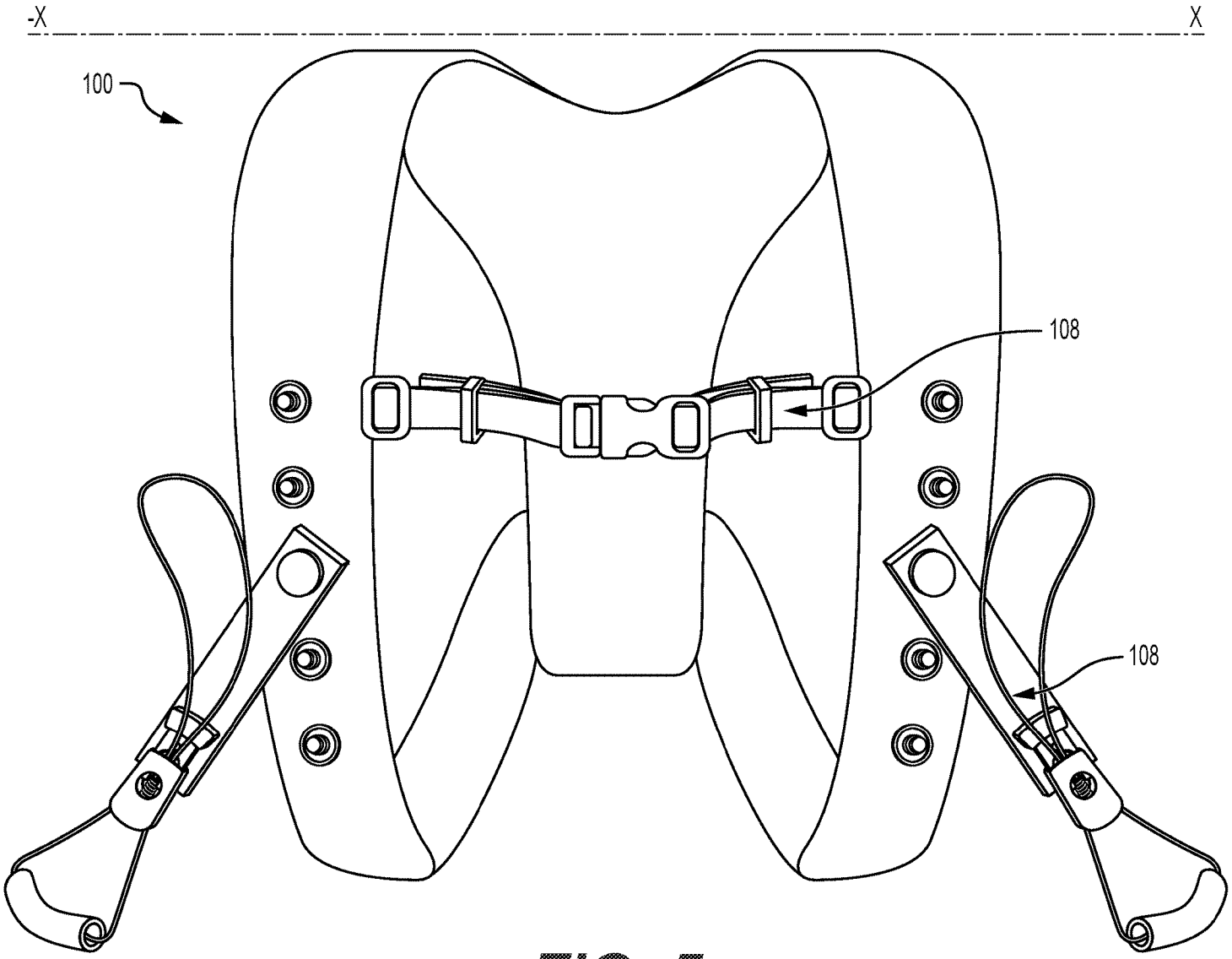
FIG. 5 illustrates an exemplary running harness having a chest strap and the one or more training devices of FIG. 1A, according to an exemplary embodiment.

FIGS. 4A and 4B illustrate a front side and a rear side, respectively, of the training device 108 and an exploded view of the lock 120. The lock 120 may be configured to allow adjustment or movement of the band 116, and a locking of the band 116 to maintain a length or position.

Referring to FIG. 4A, as an example, the lock 120 may be configured as a cord lock. The lock 12 may include an outer body or shell 402 and an inner body 404 that are slideably or elastically coupled to each other. For example, the inner body 404 may be insertable in the outer body 402, and a spring 406 may extend between an end of the inner body 404 and an inner surface of the outer body 402. The band 116 may extend between the inner body 404 and the outer body 402.

The outer body 402 may include an outer opening 408 through which the spring 406 may be exposed. The inner body 404 may include an inner opening 410. When the inner body 404 is pushed into the outer body 402 to unlock or open the lock 120, the spring 406 may be compressed, and the inner opening 410 and the outer opening 408 may be at least partially aligned, and the band 116 may be freely adjusted and/or moved. When the inner body 404 is not pushed and the spring 406 is released and/or uncompressed to lock or close the lock 120, the inner opening 410 may align with a solid portion of the outer body 402, and the outer opening 410 may align with a solid portion of the inner body 404, creating a frictional force between the inner body 404, outer body 402, and band 116 such that the band 116 may not be freely adjusted and/or moved. Aspects disclosed herein are not limited to an implementation of the lock 120, however.

Referring to FIG. 4B, the outer opening 410 may be exposed at an end of the base 112 of the training device 110 so as to reduce or prevent friction from the base 112. A rear side of the strap fastener 114 may include a button socket 414 (e.g., recess or hole) configured to snap onto and/or be pressed-fit into the protrusion 111 of the device fastener 110 of the strap 104 (FIG. 1). However, as previously mentioned, aspects disclosed herein are not limited to an implementation of the strap fastener 114 and/or the at least one device fastener 110. For example, the strap fastener 114 may include a button stud, and the at least one device fastener 110 may include a button socket to reduce a number of protrusions coming from the strap 104 and/or facilitate a smoother texture. As another example, a rear side of the strap fastener 114 may include a hook-and-loop fastener, and the device fastener 110 may include a corresponding hook-and-loop fastener configured to couple to the strap fastener 114. As another example, the strap fastener 114 may couple to the strap 104 via a zipper provided on the strap 104 and may lock in place at a selected position. As another example, the strap fastener 114 may include one or more magnets, and the device fastener 110 may include one or more corresponding magnets. A coupling between the device fastener 110 and the strap fastener 114 may be configured to withstand a force from the band 116 that pulls the device fastener 110 away from the strap fastener 114. An elasticity of the band 116 and a configuration of the lock 120 may be configured to reduce a pulling force on the device fastener 110 and/or strap fastener 114 during use.

FIGS. 5 and 6A-6C provide exemplary modifications and/or alternatives to the running harness 100. For example, referring to FIG. 5, the running harness 100 may include a chest strap 502 configured to extend across a user's chest during use and/or help to maintain a fit of the running harness 100. The chest strap 502 may be tightened and/or loosened (e.g., with a buckle). In some examples, the chest strap 502 may be used to adjust a position of the one or more training devices 108 in an X-direction to further adjust an arm swing movement.

Figure 6C:
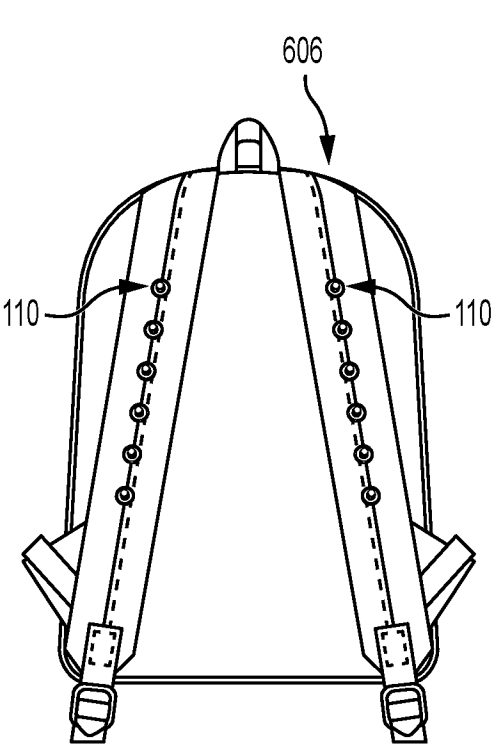
FIG. 6C illustrates an exemplary backpack configured to couple to the one or more training devices of FIG. 1A, according to an exemplary embodiment.
Figure 6B:
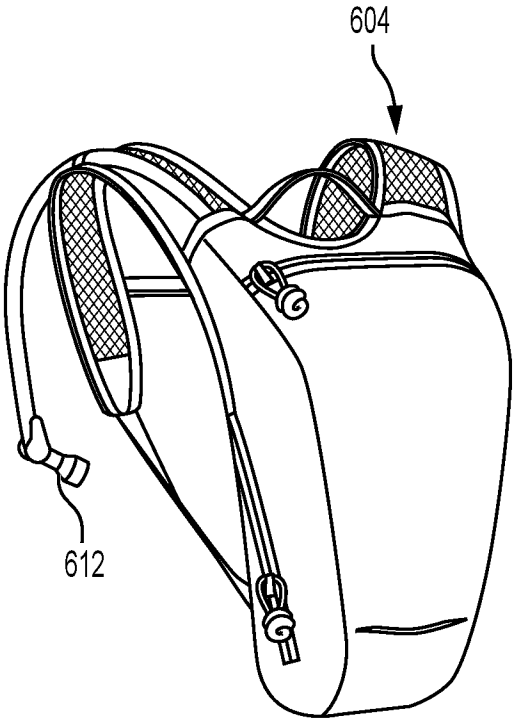
FIG. 6B illustrates an exemplary hydration pack configured to couple to the one or more training devices of FIG. 1A, according to an exemplary embodiment.
Figure 6A:
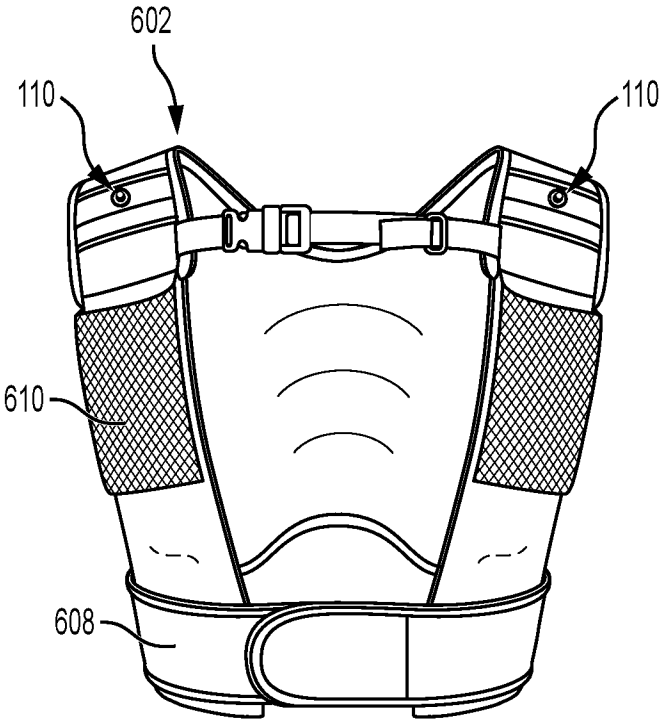
FIG. 6A illustrates an exemplary vest configured to couple to the one or more training devices of FIG. 1A, according to an exemplary embodiment.

Referring to FIG. 6A, the running harness may be implemented as a weighted vest 602 including one or more pockets 610 configured to hold one or more weights (e.g., sand bags, etc.). The weighted vest 602 may include a waist support 608, which may be configured to extend around a user's waist and provide additional support. The waist support 608 may be adjustable using, for example, hook and loop fasteners, zippers, buttons, etc.

Referring to FIG. 6B, the running harness may be implemented as a hydration pack 604 having a liquid pack or reservoir 614 and a drink tube 612 configured to extend to a user's mouth to supply liquid from the liquid pack 614 to the user for dinking. Referring to FIG. 6C, the running harness may be implemented as a backpack 606 having foam or polymer straps and a storage chamber to transport one or more items. All of the examples of FIGS. 5 and 6A-6C may include the plurality of device fasteners 110 configured to attach to the training device 108.

The following clauses provide an exemplary configuration for a running harness described above.

A running harness, comprising: a body; a first strap coupled to a first side of the body, wherein the first strap includes at least one device fastener; and a first training device, including: a base extending from a first side to a second side; a strap fastener provided at the first side of the base and configured to couple to and be removed from the at least one device fastener of the first strap, wherein a position of the strap fastener along a length of the first strap is adjustable; and a band coupled to the second side of the base and having a predetermined elasticity, wherein the band includes a loop configured to be expanded in a direction away from the second side and the strap fastener.

The running harness of clause 1, wherein a size of the loop is adjustable.

The running harness of clause 1, wherein a size of the loop is configured to receive a thumb of the user.

The running harness of clause 1, wherein a size of the loop is configured to prevent insertion of a fist.

The running harness of clause 1, wherein the predetermined elasticity, a size of the loop, and the position of the strap fastener along the length of the first strap is configured to maintain a predetermined arm swing parameter of the user during running.

The running harness of clause 1, further comprising a lock provided at the second side of the base, wherein the lock is configured to couple the band to the base.

The running harness of clause 6, wherein the lock is configured to be opened to allow adjustment of a size of the loop and closed to maintain the size of the loop.

The running harness of clause 6, wherein the lock includes a cord lock.

The running harness of clause 6, wherein a distance of the loop between the lock and an end of the loop opposite the end is in a range of 4 inches to one foot.

The running harness of clause 1, further comprising a thumb grip provided on the loop.

The running harness of clause 10, further comprising a lock configured to couple the band to the base, wherein a distance of the loop between the lock and the thumb grip is in a range of 4 inches to one foot.

The running harness of clause 1, wherein the strap fastener is a button socket or a button stud.

The running harness of clause 1, further comprising: a second strap coupled to a second side of the body, wherein the seconds strap includes at least one device fastener; and a second training device having a strap fastener configured to couple to the at least one device fastener of the second strap.

The running harness of clause 1, wherein the at least one device fastener includes a plurality of device fasteners provided along a length of the first strap.

A running harness, comprising: a body; a first strap coupled to a first side of the body; a second strap coupled to a second side of the body; a first training device coupled to the first strap; and a second training device coupled to the second strap, wherein each of the first training device and the second training device includes: a base extending from a first side to a second side, wherein the first side of the base is coupled to the first strap or the second strap; and a band coupled to the second side of the base and having a predetermined elasticity.

The running harness of clause 15, wherein: a position of the first training device along a length of the first strap is adjustable; and a position of the second training device along a length of the second strap is adjustable.

A training device configured to be attached to and removed from a strap of a harness configured to be worn by a user, the training device comprising: a base extending from a first side to a second side; a strap fastener provided at the first side of the base, the strap fastener being configured to attach to and be removed from the strap of the harness; and a band coupled to the second side of the base and having a predetermined elasticity, wherein the band includes a loop configured to be expanded in a direction away from the second side and the strap fastener.

A strap of a harness, wherein the strap is configured to attach to the training device of clause 17, and wherein the strap comprises at least one device fastener configured to couple to the strap fastener of the training device.

The strap of clause 18, wherein the at least one device fastener includes a plurality of device fasteners aligned along a length direction of the strap.

A running harness including the training device of clause 17, wherein the harness is configured to be worn by a user, and the predetermined elasticity is configured to maintain a predetermined arm swing parameter of the user during running.

We claim:

1. A running harness, comprising:
- a body;
- a first strap coupled to a first side of the body, wherein the first strap includes at least one device fastener; and
- a first training device, including:
  - a base extending from a first side to a second side;
  - a strap fastener provided at the first side of the base and configured to couple to and be removed from the at least one device fastener of the first strap, wherein a position of the strap fastener along a length of the first strap is adjustable; and
  - a band coupled to the second side of the base and having a predetermined elasticity, wherein the band includes a loop configured to be expanded in a direction away from the second side and the strap fastener.

2. The running harness of claim 1, wherein a size of the loop is adjustable.

3. The running harness of claim 1, wherein a size of the loop is configured to receive a thumb of the user.

4. The running harness of claim 1, wherein a size of the loop is configured to prevent insertion of a fist.

5. The running harness of claim 1, wherein the predetermined elasticity, a size of the loop, and the position of the strap fastener along the length of the first strap is configured to maintain a predetermined arm swing parameter of the user during running.

6. The running harness of claim 1, further comprising a lock provided at the second side of the base, wherein the lock is configured to couple the band to the base.

7. The running harness of claim 6, wherein the lock is configured to be opened to allow adjustment of a size of the loop and closed to maintain the size of the loop.

8. The running harness of claim 6, wherein the lock includes a cord lock.

9. The running harness of claim 6, wherein a distance of the loop between the lock and an end of the loop opposite the end is in a range of 4 inches to one foot.

10. The running harness of claim 1, further comprising a thumb grip provided on the loop.

11. The running harness of claim 10, further comprising a lock configured to couple the band to the base, wherein a distance of the loop between the lock and the thumb grip is in a range of 4 inches to one foot.

12. The running harness of claim 1, wherein the strap fastener is a button socket or a button stud.

13. The running harness of claim 1, further comprising:

a second strap coupled to a second side of the body, wherein the second strap includes at least one device fastener; and a second training device having a strap fastener configured to couple to the at least one device fastener of the second strap.

14. The running harness of claim 1, wherein the at least one device fastener includes a plurality of device fasteners provided along a length of the first strap.

15. A running harness, comprising:

a body;

a first strap coupled to a first side of the body;

a second strap coupled to a second side of the body;

a first training device coupled to the first strap; and a second training device coupled to the second strap, wherein each of the first training device and the second training device includes:

a base extending from a first side to a second side, wherein the first side of the base is coupled to the first strap or the second strap; and a band coupled to the second side of the base and having a predetermined elasticity.

16. The running harness of claim 15, wherein:

a position of the first training device along a length of the first strap is adjustable; and a position of the second training device along a length of the second strap is adjustable.

17. A training device configured to be attached to and removed from a strap of a harness configured to be worn by a user, the training device comprising:

a base extending from a first side to a second side;

a strap fastener provided at the first side of the base, the strap fastener being configured to attach to and be removed from the strap of the harness; and a band coupled to the second side of the base and having a predetermined elasticity, wherein the band includes a loop configured to be expanded in a direction away from the second side and the strap fastener.

18. A strap of a harness, wherein the strap is configured to attach to the training device of claim 17, and wherein the strap comprises at least one device fastener configured to couple to the strap fastener of the training device.

19. The strap of claim 18, wherein the at least one device fastener includes a plurality of device fasteners aligned along a length direction of the strap.

20. A running harness including the training device of claim 17, wherein the harness is configured to be worn by a user, and the predetermined elasticity is configured to maintain a predetermined arm swing parameter of the user during running.

* * * * *